US008375741B2

(12) United States Patent
Taras et al.

(10) Patent No.: US 8,375,741 B2
(45) Date of Patent: Feb. 19, 2013

(54) REFRIGERANT SYSTEM WITH INTERCOOLER AND LIQUID/VAPOR INJECTION

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 421 days.

(21) Appl. No.: 12/676,026

(22) PCT Filed: Dec. 26, 2007

(86) PCT No.: PCT/US2007/088794

§ 371 (c)(1), (2), (4) Date: Mar. 2, 2010

(87) PCT Pub. No.: WO2009/082405

PCT Pub. Date: Jul. 2, 2009

(65) Prior Publication Data

US 2010/0199694 A1 Aug. 12, 2010

(51) Int. Cl.
*F25B 1/10* (2006.01)

(52) U.S. Cl. ..... 62/510; 62/513

(58) Field of Classification Search ..... 62/117, 62/505, 510, 513

See application file for complete search history.

(56) References Cited

U.S. PATENT DOCUMENTS

| | | | |
|---|---|---|---|
| 4,369,633 | A | 1/1983 | Snyder |
| 2005/0132729 | A1 | 6/2005 | Manole |
| 2007/0006607 | A1 | 1/2007 | Hunt |

FOREIGN PATENT DOCUMENTS

| | | |
|---|---|---|
| WO | WO2007046810 | 4/2007 |
| WO | WO2007142619 | 12/2007 |

OTHER PUBLICATIONS

International Preliminary Report on Patentability mailed Jul. 8, 2010.
Search Report and Written Opinion mailed on Jul. 7, 2008 for PCT/US2007/088794.

*Primary Examiner* — Mohammad Ali
(74) *Attorney, Agent, or Firm* — Carlson, Gaskey & Olds, PC

(57) ABSTRACT

A refrigerant system is provided with at least two sequential stages of compression. An intercooler is positioned intermediate the two stages. The refrigerant flowing through the intercooler is cooled by a secondary fluid such as ambient air. A vapor/liquid injection function is also provided for the refrigerant system. The intercooler function and the vapor/liquid injection function are selectively activated on demand depending on environmental conditions and thermal load in a conditioned space. This invention is particularly important for the CO2 refrigerant systems operating in the transcritical cycle.

20 Claims, 1 Drawing Sheet

REFRIGERANT SYSTEM WITH INTERCOOLER AND LIQUID/VAPOR INJECTION

This application is a United States National Phase application of PCT Application No. PCT/US2007/088794 filed Dec. 26, 2007.

BACKGROUND OF THE INVENTION

This application relates to refrigerant systems, wherein the compressor is a multi-stage compressor (e.g. a two-stage compressor), and wherein an intercooler and liquid/vapor injection are provided between the compression stages. The intercooler is preferably subjected to an ambient airflow and, such that the cooling in the intercooler is preferably provided by circuitry and components that are already part of the refrigerant system.

Air conditioning, heat pump and refrigeration systems provide cooling or heating of a secondary fluid, such as air, delivered into a climate-controlled environment. A typical basic air conditioning, heat pump or refrigeration system includes a compressor, an expansion device, a heat rejecting heat exchanger and a heat accepting heat exchanger. The heat rejecting heat exchanger is either a condenser for subcritical applications or a gas cooler for transcritical applications, while a heat accepting heat exchanger is typically an evaporator. The heat pumps also include a refrigerant flow reversing device, typically a four-way valve that allows for refrigerant flow reversals throughout the refrigerant system while switching between cooling and heating modes of operation.

To obtain additional capacity, enhance system efficiency and achieve higher compression ratios without exceeding the discharge temperature threshold, it is often the case that a two-stage compressor (or a three-stage compressor, in some cases) is provided in a refrigerant system. With a two-stage compressor, two separate compression members or two separate compressor units are disposed in series. Specifically, for instance, in the case of a reciprocating compressor, two separate compression members may be represented by different banks of cylinders connected in series. Refrigerant compressed by a lower stage to an intermediate pressure is delivered from a discharge outlet of this lower stage to the suction inlet of the upper stage. If the compression ratio for the compressor system is high (which is typically the case for two-stage compression systems) and/or refrigerant suction temperature is high (which is often the case for a refrigerant system equipped with a liquid-suction heat exchanger), then refrigerant discharge temperature can also become extremely high, and in many cases may exceed the limit defined by the safety or reliability considerations.

Thus, it is known in the art to provide an intercooler heat exchanger (or a so-called intercooler) between the compression stages to extend the operational envelope and/or improve system performance and reliability. In an intercooler, refrigerant flowing between the two compression stages is typically cooled by a secondary fluid. Quite often, additional components and circuitry are required to provide cooling of the refrigerant in the intercooler. As an example, a fan or pump is included to move a secondary cooling fluid from a cold temperature source to cool the refrigerant in the intercooler.

It is also known in the art to provide refrigerant liquid/vapor injection to reduce discharge temperature, extend the compressor operational envelope and improve system performance and reliability. In such refrigerant systems, at least a portion of refrigerant leaving a heat rejecting heat exchanger is partially expanded in an auxiliary expansion device to an intermediate pressure and temperature and routed to a point between the compression stages where it is mixed with the refrigerant partially compressed in a lower compression stage and to be delivered to an upper compression stage. As also known, the vapor injection circuit may include an economizer heat exchanger to provide additional cooling to the refrigerant circulating through the main circuit and thus provide additional capacity to the refrigerant system.

Recently, new generation refrigerants, such as natural refrigerants, are being utilized in refrigerant systems. One very promising refrigerant is carbon dioxide (also known as $CO_2$ or R744). Particularly with $CO_2$ refrigerant systems, an intercooler and refrigerant liquid/vapor injection functions become even more important, as these refrigerant systems tend to operate at high discharge temperatures due to high operating pressures, use of a liquid-suction heat exchanger, a high value of the polytropic compression exponent for the $CO_2$ refrigerant and, in general, by the transcritical nature of the $CO_2$ cycle. However, the additional cost of the circuitry and components associated with the intercooler and liquid/vapor injection, along with the limited benefits for prior art refrigerant systems utilizing conventional refrigerants, made the provision of an intercooler and liquid/vapor injection in the conventional refrigerant systems less practical.

Thus, it is desirable to provide an intercooler and liquid/vapor injection for a multi-stage compressor refrigerant system, and particularly for a $CO_2$ refrigerant system, as well as a selective activation method of these components to achieve the most efficient and reliable operation of a refrigerant system over a wider spectrum of environmental conditions.

SUMMARY OF THE INVENTION

In a disclosed embodiment of this invention, a refrigerant system incorporates a multi-stage compressor. An intercooler and liquid/vapor injection are provided between at least two of the compression stages connected in series. The intercooler is preferably positioned to be subjected to an airflow passing over a heat rejecting heat exchanger. In one configuration, an intercooler is positioned in series with the heat rejecting heat exchanger, with respect to the ambient airflow, and in another configuration, an intercooler is positioned in parallel with the heat rejecting heat exchanger, with respect to the ambient airflow. Further, an outdoor fan that passes air over the heat rejecting heat exchanger may also provide cooling for the intercooler, while both heat exchangers may or may not share the same construction.

In one arrangement, an intercooler is positioned between the same compression stages where a liquid/vapor injection function is provided, and in another arrangement, an intercooler is positioned between different compression stages than the compression stages between which liquid/vapor injection function is provided.

At certain environmental conditions and thermal load demands, an intercooler may be engaged at the same time when liquid/vapor injection is activated. On the other hand, at other environmental conditions and thermal load demands, either an intercooler or liquid/vapor injection function may be more preferable.

The intercooler increases system capacity and improves efficiency, since the compressor discharge temperature is reduced, and the heat rejecting heat exchanger is typically capable to cool refrigerant to a lower temperature, providing a higher cooling potential in the evaporator. Additionally, a steeper slope of the isentropic lines for the downstream compression stages allows for a higher compressor isentropic efficiency. Furthermore, lower discharge temperatures promote higher compressor reliability and operational envelope extension.

Additionally, if the refrigerant system operates in a transcritical cycle, where high side temperature and pressure are independent from each other, the discharge pressure is no longer limited by a discharge temperature and can be adjusted to a specified value for an optimum performance level. Thus, the transcritical refrigerant system efficiency and capacity are enhanced even further.

Liquid/vapor injection provides similar benefits but may be activated at different environmental conditions and thermal load demands. Additionally, in case an economizer heat exchanger is provided, extra subcooling and additional thermal potential are gained in the evaporator.

These and other features of the present invention can be best understood from the following specification and drawings, the following of which is a brief description.

DETAILED DESCRIPTION OF THE PREFERRED EMBODIMENTS

Figure 1:
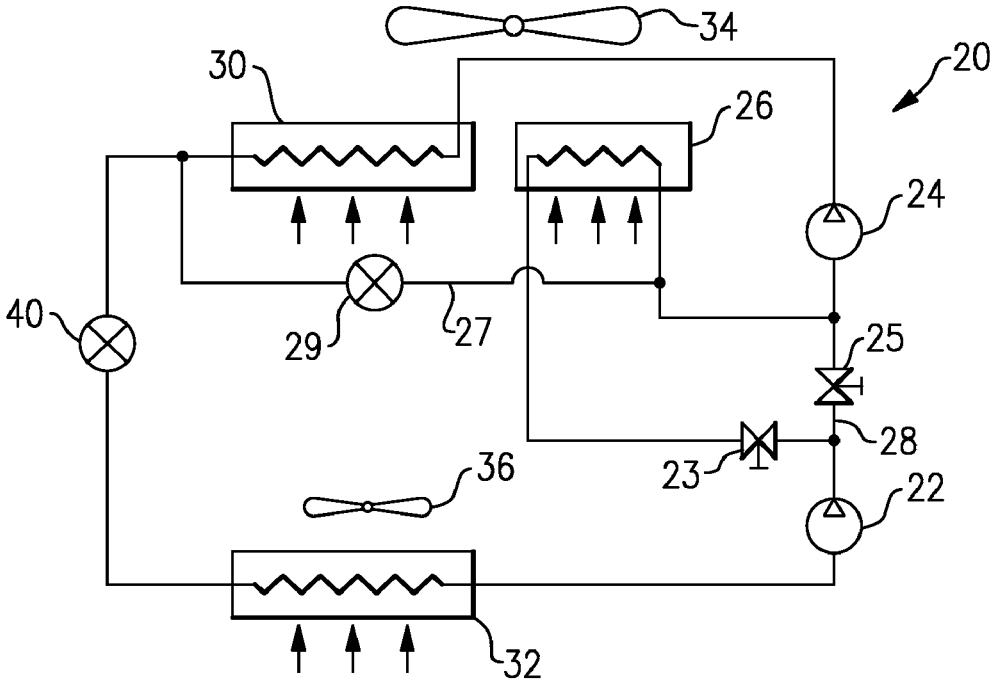
FIG. 1 shows a schematic of an inventive refrigerant system.

A refrigerant system 20 is illustrated in FIG. 1 having a lower stage compressor 22 and a higher stage compressor 24. While only two sequential stages are shown, additional stages may also be incorporated in series in this invention. Also, instead of separate compressors connected in sequence, a multi-stage single compressor arrangement can be employed and equally benefit from the present invention. For instance, the two illustrated, separate compression members may be represented by different banks of cylinders connected in series for a reciprocating compressor. As known, refrigerant compressed by a lower stage compressor 22 to an intermediate pressure is delivered from a discharge outlet of this lower stage compressor 22 to the suction inlet of the higher stage compressor 24. An intercooler 26 is positioned between the two stages to accept refrigerant from a discharge outlet of the lower stage compressor 22. This refrigerant is cooled by a secondary media, such as ambient air blowing over external heat transfer surfaces of the intercooler 26, during heat transfer interaction with the refrigerant, is delivered downstream to a suction inlet of the higher stage compressor 24. Again, if additional stages of compression are provided, additional intercoolers may also be positioned between those stages.

Further, an intercooler bypass line 28 incorporating a refrigerant flow control device 25 may be provided. An intercooler bypass line bypasses at least a portion of refrigerant around the intercooler 26 when full intercooling capability may not be required. A refrigerant flow control device 25 may be, for instance, a fixed restriction orifice, on/off or pulsing solenoid valve or a modulating valve. The last two refrigerant flow control devices provide regulating capability for the amount of refrigerant bypassing the intercooler 26. In case extra refrigerant flow control flexibility may be needed, an additional refrigerant flow control device 23 may be positioned within intercooler circuit to control refrigerant flow through the intercooler 26. The refrigerant flow control device 23 may be of an on/off or pulsing solenoid valve type or a modulating valve type. Further, the independent refrigerant flow control devices 23 and 25 may be combined into a three-way valve of a regular on/off type or a regulating type.

A fan or other air-moving device 34 moves air over a heat rejecting heat exchanger 30 and the intercooler 26. In cases when a separate air-moving device is implemented to blow air over external surfaces of the intercooler 26, this air-moving device may be driven by a variable speed motor or a multi-speed motor to provide additional flexibility in the intercooler operation and control.

The intercooler 26 may be positioned within the same structure as the heat rejecting heat exchanger 30 or may be positioned to comprise its own structure. If the intercooler 26 shares the same structure with the heat rejecting heat exchanger 30, the two heat exchangers may be positioned in a parallel configuration or in a serial configuration, with respect to the airflow. In the latter case, the intercooler 26 is preferably positioned upstream of the heat rejecting heat exchanger 30, in relation to the airflow, and such that the fan 34 also moves air over the external surfaces of the intercooler 26. Also, as mentioned above, the intercooler 26 may have its own fan. In the case of the intercooler 26 position upstream of the heat rejection heat exchanger 30, although the air stream will be preheated by the intercooler 26 before reaching the heat rejecting heat exchanger 30, during heat transfer interaction between the air and refrigerant in the intercooler 26, the temperature of the refrigerant flowing through the intercooler 26 is reduced, as desired, as well as the refrigerant system 20 will have a more compact design. As also known, other secondary media such as water or glycol can be used instead of air, and consequently, the fan 34 can be replaced by a liquid pump circulating this fluid through a secondary circuit.

As is also known, an expansion device 40 is positioned between the heat rejecting heat exchanger 30 and an evaporator 32 with associated air-moving device such as fan 36 blowing air over external surfaces of the evaporator 32.

The intercooler 26 extends an operational envelope of the refrigerant system 20, as well as increases its capacity and efficiency, since the compressor discharge temperature is reduced and the heat rejecting heat exchanger 30 may be capable to cool refrigerant to a lower temperature, providing a higher cooling potential for the refrigerant entering the evaporator 32. Compressor power consumption may also be reduced, as heat removed from the compression process is rejected at the lower high side pressure. Also, a steeper slope of the isentropic lines for the downstream compression stages allows for a higher compressor isentropic efficiency. Additionally, if the refrigerant system 20 operates in a transcritical cycle, where the high side temperature and pressure are independent from each other, the discharge pressure is not limited by a discharge temperature anymore and can be adjusted to a value corresponding to an optimum performance level. Furthermore, in both subcritical and transcritical cycles, the temperature of the refrigerant discharged from the higher compression stage 24 is reduced, improving reliability of the compressor. Thus, performance (efficiency and capacity) of the refrigerant system 20 is increased and compressor reliability is improved.

The refrigerant system 20 also includes a vapor/liquid injection line 27 that incorporates an auxiliary expansion device 29. When the vapor/liquid injection circuit is activated, at least a portion of refrigerant exiting heat rejecting heat exchanger 30 is rerouted through the vapor/liquid injection line 27 to be expanded to a lower pressure and temperature in the auxiliary expansion device 29 and injected in between the lower and upper compression stages 22 and 24. Since this portion of refrigerant has a lower temperature it can cool partially compressed main refrigerant to subsequently achieve a lower discharge temperature. It should be pointed out that in case the auxiliary expansion device 29 is not equipped with the shutoff functionality, an additional shutoff valve may be required in the vapor/liquid injection line 27. The vapor/liquid injection line 27 may contain a liquid-vapor refrigerant mixture, if the end state for the expansion process in the auxiliary expansion device 29 is located inside the two-phase dome, or may contain purely liquid refrigerant, if the end state for the expansion process in the auxiliary expansion device 29 is still located outside of the two-phase dome. This would depend on the refrigerant type as well as environmental and operating conditions. The injection point is preferably positioned downstream of the intercooler 26 and upstream of the second compression stage 24.

Therefore, the refrigerant system 20 can utilize either the intercooler 26, vapor/liquid injection through the injection line 27 or simultaneously both of these functions to reduce discharge temperature and achieve all the benefits outlined hereinabove. Which function is to be activated will depend on environmental and operating conditions, as will be explained below.

Figure 2:
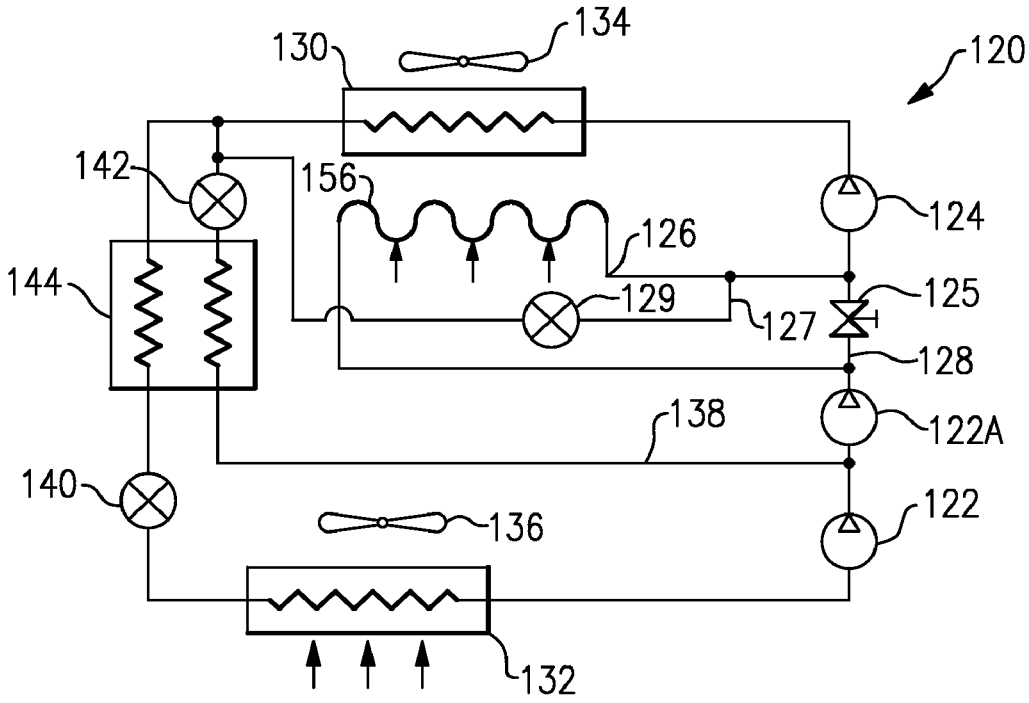
FIG. 2 shows a second schematic of an inventive refrigerant system.

FIG. 2 shows another embodiment 120, wherein a refrigerant system has three sequential compression stages 122, 122A and 124. A refrigerant connection line 126 intermediate higher compression stages 122A and 124 is routed to be in the path of air being flown over the heat rejecting heat exchanger 130 by a an associated fan 134. As shown, the refrigerant connection line 126 may or may not have a heat transfer enhancement structure 156 and performs an intercooling function, as discussed in reference to the FIG. 1 embodiment. A bypass line 128 bypasses at least a portion of refrigerant around the intercooling line 126, if desired, and as in the FIG. 1 embodiment includes a refrigerant flow control device 125. An expansion device 140, an evaporator 132 with an associated fan 136, a vapor/liquid injection line 127 incorporating an auxiliary expansion device 129 are included and similar to the FIG. 1 embodiment. Additionally, an economizer heat exchanger 144 is positioned downstream of the heat rejection heat exchanger 130, with respect to refrigerant flow. When an economizer circuit is activated, a portion of refrigerant is expanded to a lower pressure in an economizer expansion device 142 and diverted via an economizer line 138 to a point between compression stages 122 and 122A. Since this economized refrigerant is at colder temperature than the main refrigerant exiting the heat rejecting heat exchanger 130, it can cool this main refrigerant, during heat transfer interaction in the economizer heat exchanger 144, enhancing refrigerant system 120 performance characteristics (capacity and efficiency). Further, this economized refrigerant can cool partially compressed refrigerant by the lower compression stage 122, while mixing with this refrigerant. In case the economizer expansion device 142 is not equipped with the shutoff capability, an additional shutoff valve may be required for the economizer circuit. As known, an economizer circuit can have a number of different configurations including, but not limited to, arrangements for tapping an economized refrigerant flow upstream and downstream of the economizer heat exchanger 144, as well as schematics incorporating a flash tank.

The refrigerant system 120 can utilize either the intercooling line 126, vapor/liquid injection through the injection line 127, economizer function through the economizer line 138 or any combination of these functions to reduce discharge temperature and achieve all the benefits outlined hereinabove. Which function is to be activated will depend on environmental and operating conditions, as will be explained below.

The present invention is particularly useful in refrigerant systems that utilize $CO_2$ as a refrigerant, since the $CO_2$ refrigerant has a high value of a polytropic compression exponent, and high side operating pressures and pressure ratios of such systems can be very high, promoting higher than normal discharge temperatures. Still, the invention would extend to refrigerant systems utilizing other refrigerants.

When augmented system capacity is required by thermal load demands in the conditioned space or/and by high ambient temperature—low indoor temperature environmental conditions and the compressor discharge temperature needs to be reduced at the same time, an economizer function is turned on (if present), a vapor/liquid injection function is turned off and an intercooler function may be turned on (especially for transcritical applications). The economizer line typically returns refrigerant between lower compression stages to achieve maximum temperature difference in the economizer heat exchanger and maximum capacity boost, and by the time the refrigerant reaches the higher compression stages, it may need to be additionally cooled to either satisfy the discharge temperature requirements or provide decoupling for pressure and temperature in transcritical applications. The intercooler is typically provided between the higher compression stages, since the refrigerant in the intercooler needs to be at a noticeably higher temperature than the cooling media such as ambient air, in order to provide positive intercooling effect. If the economizer and intercooler are positioned between the same compression stages, then the economizer would be preferably positioned upstream of the intercooler, for the reasons outlined above. The vapor/liquid injection function is turned off to provide maximum refrigerant flow in the evaporator and subsequently maximum capacity. In case the discharge temperature is still above the predetermined threshold, the vapor/liquid injection function would be activated. The vapor/liquid injection function may be positioned in between the same compression stages as the intercooler function or in between lower compression stages. The vapor/liquid injection function could be switched to be redirected in between different compression stages as well, if desired.

If reduced capacity may be needed and lower discharge temperature is simultaneously required, then vapor/liquid injection is activated first and is followed by the intercooler function engagement, if required. In case of refrigerant system capacity matching thermal load demands in the conditioned space or system capacity reduction provided by other available unloading options, the intercooler function is activated first to approach the desired discharge temperature that is followed by the vapor/liquid injection as a second stage of the discharge temperature reduction.

As stated hereinabove, the vapor/liquid injection function and the intercooler function could be adjusted via modulating or pulsing control techniques for the refrigerant flow control devices such as valves. For the intercooler function, the adaptive control can be applied to the airflow passing over the intercooler external surfaces, for instance, by a variable speed or multi-speed air-moving device such as a fan.

It should be noted that this invention is not limited to the refrigerant systems shown in the FIGS. 1 and 2, as the actual refrigerant system may include additional components, such as, for example, a liquid-suction heat exchanger, a reheat coil, an additional intercooler, an additional economizer heat exchanger or a flash tank. The individual compression stages may include several compressors arranged in tandem. The compressors can be of variable capacity type, including variable speed and multi-speed configurations. Further, the compressors may have various unloading options, including intermediate pressure to suction pressure bypass arrangement, or the compressors may be unloaded internally, as for example, by separating fixed and orbiting scrolls from each other on an intermittent basis. These system configurations are also not limited to a particular compressor type and may include scroll compressors, screw compressors (single or multi-rotor configurations), reciprocating compressors (where, for example, some of the cylinders are used as a low compression stage and other cylinders are used as a high compression stage) and rotary compressors. The refrigerant system may also consist of multiple separate circuits. The present invention would also apply to a broad range of systems, for example, including mobile container, truck-trailer and automotive systems, packaged commercial rooftop units, supermarket installations, residential units, environmental control units, etc., as well as be extended to the heat pump applications.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A refrigerant system comprising:

a compressor assembly including at least two stages of compression connected in series, with a lower compression stage compressing refrigerant from a suction pressure to an intermediate pressure and passing this refrigerant to a higher compression stage compressing refrigerant from an intermediate pressure to a discharge pressure;

an intercooler positioned intermediate of said lower and higher compression stages;

a liquid/vapor injection function with a vapor injection connection positioned intermediate of said lower and higher compression stages;

a heat rejecting heat exchanger positioned downstream of said higher compression stage, an evaporator positioned upstream of said lower compression stage and an expansion device positioned intermediate of said heat rejecting heat exchanger and said evaporator;

at least one secondary fluid moving device for moving secondary fluid in at least one secondary fluid path over said heat rejecting heat exchanger and said intercooler; and said intercooler and said liquid/vapor injection function are selectively activated to control refrigerant discharge temperature depending on environmental and operational conditions as well as thermal load demands in a conditioned space.

2. The refrigerant system as set forth in claim 1, wherein said at least two compression stages are positioned within one compressor.

3. The refrigerant system as set forth in claim 1, wherein said at least two compression stages are represented by separate compressors.

4. The refrigerant system as set forth in claim 1, wherein the refrigerant system operates at least in part in the transcritical cycle.

5. The refrigerant system as set forth in claim 1, wherein the refrigerant system operates at least in part in the subcritical cycle.

6. The refrigerant system as set forth in claim 1, wherein said liquid/vapor injection function includes an economizer heat exchanger or a flash tank.

7. The refrigerant system as set forth in claim 1, wherein said at least two compression stages include three compression stages.

8. The refrigerant system as set forth in claim 7, wherein said intercooler and said liquid/vapor injection function are positioned between the same lower and higher compression stages.

9. The refrigerant system as set forth in claim 8, said liquid/vapor injection function is positioned downstream of said intercooler, with respect to refrigerant flow.

10. The refrigerant system as set forth in claim 7, wherein said intercooler and said liquid/vapor injection function are positioned between different lower and higher compression stages.

11. The refrigerant system as set forth in claim 10, wherein said intercooler is positioned between higher second and third compression stages and said liquid/vapor injection function is positioned between lower first and said second compression stages.

12. The refrigerant system as set forth in claim 1, wherein said refrigerant system includes refrigerant bypass line around said intercooler and said intercooler being at least partially disengaged on demand.

13. The refrigerant system as set forth in claim 12, wherein said refrigerant system has control capability to control refrigerant flow through the intercooler.

14. The refrigerant system as set forth in claim 1, wherein said intercooler has a separate secondary fluid moving device and said secondary fluid moving device has capability to vary a flow of secondary fluid.

15. The refrigerant system as set forth in claim 1, wherein said liquid/vapor injection function is equipped with an economizer heat exchanger and further wherein said economized liquid/vapor injection function is engaged first, said intercooler is engaged second and said non-economized liquid/vapor injection function is engaged third to control discharge temperature, if extra capacity is required to control environmental conditions in a climate-controlled space.

16. The refrigerant system as set forth in claim 1, wherein said intercooler is engaged first and said liquid/vapor injection function is engaged second to control discharge temperature, if no extra capacity is required to control environmental conditions in a climate-controlled space.

17. The refrigerant system as set forth in claim 1, wherein said liquid/vapor injection function is engaged first and said intercooler is engaged second to control discharge temperature, if reduced capacity is required to control environmental conditions in a climate-controlled space.

18. A method of operating a refrigerant system including the steps of:

(a) providing a compressor assembly including at least two stages of compression connected in series, with a lower compression stage compressing refrigerant from a suction pressure to an intermediate pressure and passing this refrigerant to a higher compression stage compressing refrigerant from an intermediate pressure to a discharge pressure;

(b) positioning an intercooler intermediate of said lower and higher compression stages;

(c) positioning a liquid/vapor injection function with a vapor injection connection intermediate of said lower and higher compression stages;

(d) positioning a heat rejecting heat exchanger downstream of said higher compression stage, positioning an evaporator upstream of said lower compression stage and positioning an expansion device intermediate of said heat rejecting heat exchanger and said evaporator;

(e) moving a secondary fluid in at least one secondary fluid path over said heat rejecting heat exchanger and said intercooler; and (f) selectively activating said intercooler and said liquid/vapor injection function to control refrigerant discharge temperature depending on environmental and operational conditions as well as thermal load demands in a conditioned space.

19. The method as set forth in claim 18, wherein said refrigerant system includes refrigerant bypass line around said intercooler and said intercooler being at least partially disengaged on demand.

20. The method as set forth in claim 18, wherein said intercooler has a separate secondary fluid moving device and said secondary fluid moving device has capability to vary a flow of secondary fluid.

* * * * *